US010186411B2

(12) United States Patent
Makarov

(10) Patent No.: US 10,186,411 B2
(45) **Date of Patent: *Jan. 22, 2019**

(54) METHOD AND APPARATUS FOR MASS SPECTROMETRY

(71) Applicant: Thermo Fisher Scientific (Bremen) GmbH, Bremen (DE)

(72) Inventor: Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/955,454

(22) Filed: Dec. 1, 2015

(65) Prior Publication Data

US 2016/0079052 A1 Mar. 17, 2016

Related U.S. Application Data

(63) Continuation of application No. 14/347,625, filed as application No. PCT/EP2012/068839 on Sep. 25, 2012, now Pat. No. 9,209,005.

(30) Foreign Application Priority Data

Sep. 30, 2011 (GB) ..... 1116837.4

(51) Int. Cl.

| | |
|---|---|
| ***H01J 49/00*** | (2006.01) |
| ***H01J 49/40*** | (2006.01) |
| ***H01J 49/06*** | (2006.01) |
| ***H01J 49/02*** | (2006.01) |

(52) U.S. Cl.

CPC ..... *H01J 49/40* (2013.01); *H01J 49/0027* (2013.01); *H01J 49/02* (2013.01); *H01J 49/067* (2013.01); *H01J 49/406* (2013.01)

(58) Field of Classification Search

CPC ..... H01J 49/40; H01J 49/0027; H01J 49/02; H01J 49/067; H01J 49/406

USPC ..... 250/281, 282, 286, 287, 288, 290, 294

See application file for complete search history.

(56) References Cited

U.S. PATENT DOCUMENTS

| | | | |
|---|---|---|---|
| 5,793,039 | A | 8/1998 | Oishi et al. |
| 5,986,259 | A | 11/1999 | Hirabayashi et al. |
| 9,209,005 | B2 * | 12/2015 | Makarov |
| 2002/0190199 | A1 | 12/2002 | Li |
| 2003/0071208 | A1 | 4/2003 | Hansen |

(Continued)

FOREIGN PATENT DOCUMENTS

| | | | |
|---|---|---|---|
| EP | 1137044 | A2 | 9/2001 |
| GB | 2400976 | A | 10/2004 |

(Continued)

*Primary Examiner* — Nicole Ippolito
*Assistant Examiner* — Hanway Chang
(74) *Attorney, Agent, or Firm* — Nicholas Caims

(57) ABSTRACT

A method for analyzing ions according to their mass-to-charge ratio and mass spectrometer for performing the method, comprising directing a collimated ion beam along an ion path from an ion source to an ion detector, causing a portion of the ion beam to contact one or more surfaces prior to reaching the ion detector, wherein the method comprises providing a coating on and/or heating the one or more surfaces to reduce variation in their surface patch potentials. The method is applicable to multi-reflection time-of-flight (MR TOF) mass spectrometry.

13 Claims, 2 Drawing Sheets

(56) References Cited

U.S. PATENT DOCUMENTS

| | | | | |
|---|---|---|---|---|
| 2009/0140140 | A1 | 6/2009 | Raznikov et al. | |
| 2010/0243881 | A1 | 9/2010 | Dzepina et al. | |
| 2011/0017907 | A1* | 1/2011 | Makarov ..... | H01J 49/406<br>250/282 |

FOREIGN PATENT DOCUMENTS

| | | | |
|---|---|---|---|
| GB | 2403063 | A | 12/2004 |
| GB | 2455977 | A | 7/2009 |
| GB | 2470293 | A | 11/2010 |
| WO | WO 2005/001878 | A2 | 1/2005 |
| WO | WO 2006/102430 | A2 | 9/2006 |
| WO | WO 2010/111552 | A1 | 9/2010 |

* cited by examiner

| | |
|---|---|
| U1x | -528 |
| U2x | -7802 |
| U3x | 7733 |
| U4x | 162 |
| U5x | 3910 |

METHOD AND APPARATUS FOR MASS SPECTROMETRY

CROSS-REFERENCE TO RELATED APPLICATIONS

The present application is a continuation under 35 U.S.C. § 120 and claims the priority benefit of co-pending U.S. patent application Ser. No. 14/347,625, filed Mar. 26, 2014, which is a National Stage application under 35 U.S.C. § 371 of PCT Application No. PCT/EP2012/068839, filed Sep. 25, 2012. The disclosures of each of the foregoing applications are incorporated herein by reference.

FIELD OF THE INVENTION

The present invention relates to the field of mass spectrometry and particularly, but not exclusively, time-of-flight mass spectrometry.

BACKGROUND OF THE INVENTION

Time of flight (TOF) mass spectrometers are widely used to determine the mass-to-charge ratio (m/z) of ions on the basis of their flight time along a flight path. Ions are emitted from a pulsed ion source in the form of a short ion pulse and are directed along a prescribed flight path through an evacuated space to reach an ion detector. The ion source is arranged so that the ions leave the source with a constant kinetic energy and therefore reach the detector after a time which depends upon their mass, more massive ions being slower. The detector then provides an output to a data acquisition system and a mass spectrum can be constructed. The present invention is applicable to such TOF mass spectrometry amongst other forms of mass spectrometry.

In modern time-of-flight (TOF) mass spectrometry, multiple-reflection TOF (MR TOF) systems employing ion mirrors are known as one of the ways to improve resolving power without increasing greatly the size of an instrument. This is achieved by an increase of the ion path length in such systems. However, the performance of MR TOF instruments is limited mainly by the ion optical properties of the ion mirrors. Thus, it is especially important to develop a robust, reliable and simplified mirror design enabling high resolving power as well as high transmission of ions. In addition, it is important to minimise potential space charge effects which would otherwise limit the dynamic range of the MR TOF instrument.

Many proposals for MR TOF, for example, as described in U.S. Pat. No. 3,226,543, U.S. Pat. No. 6,013,913, U.S. Pat. No. 6,107,625, WO 02/103747, WO 2008/071921, have utilised multiple reflections between two coaxial ion mirrors. However, this geometry severely limits the mass range of the analysis due to overlap of ions of different mass-to-charge ratio after a certain number of reflections.

Multiple-reflection ion mirrors for time-of-flight mass spectrometry without mass range limitation have been described by H. Wollnik in GB 2,080,021. In Wollnik's design, each mirror typically provides one reflection and the mirrors are presumed independent and could have either planar or cylindrical symmetry. This construction requires ion trajectories with a large angle of incidence at the ion mirrors and the whole system is complex.

Another multiple-reflection TOF design has been proposed in SU 1,725,289 by Nazarenko, wherein two opposing elongated planar mirrors allow multiple reflections of ions between them together with displacement along the direction of mirror elongation ("shift direction", Z). Though such a construction is simple and allows ion focusing in the two directions other than Z, unlimited divergence of the ion beam along Z limits the mirror performance when used with modern ion sources.

The problem of de-focusing in the Z-direction in the Nazarenko geometry has been addressed by A. Verentchikov et al. in WO 2005/001878, wherein a design is described having additional planar lenses periodically positioned in the space between the opposing elongated mirrors so that the ion beam is repetitively focused as it spreads along Z. Such mirrors have also been proposed for use in tandem mass spectrometry (US 2006/0214100 A, US 2007/0029473 A). High resolving power of such mirrors has been demonstrated experimentally. However, the focusing by the lenses remains relatively weak in comparison to focusing in other directions which limits the acceptance of the analyser. Also, the location of lenses in the middle of the mirror assembly complicates the implementation of the design. For example, it restricts the location of any detector(s) in the same plane, which normally coincides with the plane of time-of-flight focusing of the mirrors, and necessitates an additional isochronous ion transfer as shown in US 2006/0214100 A.

SUMMARY OF THE INVENTION

Against this background, in one aspect, the present invention provides a method of analysing ions according to their mass-to-charge ratio comprising directing a collimated ion beam along an ion path from an ion source to an ion detector, causing a portion of the ion beam to contact one or more surfaces prior to reaching the ion detector, wherein the method comprises providing a coating on and/or heating the one or more surfaces to reduce the variation in their surface patch potentials.

The present invention, in another aspect, provides a mass spectrometer comprising: an ion source for generating an ion beam, a collimator to collimate the ion beam, an ion detector for detecting ions from the ion beam and one or more surfaces located along the ion path intermediate between the ion source and the ion detector for intercepting a portion of the ion beam, wherein the one or more surfaces are provided with a coating and/or are heatable to reduce the variation in their surface patch potentials.

The variation in the surface patch potentials, e.g. by heating, is reduced at least for the duration of analysing the ions, i.e. for the duration when the portion of ion beam is in contact with the one or more surfaces. It will be appreciated that the coating should have a lower variation in surface patch potentials than the material on which it is coated. The variation in surface patch potentials to be reduced may be a variation in space or time or both.

Analysing the ions preferably comprises separating the ions according to their mass-to-charge ratio, more preferably separating the ions according to their mass-to-charge ratio along the ion path from the ion source to the ion detector. The mass spectrometer is preferably a TOF mass spectrometer, i.e. wherein the ions are separated by their time-of-flight as they travel in an ion beam along an ion path from an ion source, but it could also be another mass spectrometer, such as a magnetic sector mass spectrometer or electrostatic trap for example. More preferably, the spectrometer is a multi-reflection (MR) TOF mass spectrometer. The invention is thus applicable to high resolution TOF mass spectrometers. The ion beam preferably undergoes multiple changes of direction between the ion source and the detector. The ion beam, for example, is repeatedly reflected between ion mirrors. As described above, the long path length and multiple reflections in ion mirrors in MR TOF instruments lead to particular problems in maintaining a low divergent beam, especially in a shift direction of a planar mirror MR TOF arrangement. In the present invention, the provision of a collimated ion beam and use of the one or more surfaces along the ion path having a low variation in surface patch potentials, for example to clip the edges of the beam, can facilitate the maintenance of a low divergence ion beam, particularly as the beam undergoes multiple reflections or changes of direction. Thus, a collimated beam may be maintained with low divergence without the use of a costly and complex arrangement of periodic focusing lenses as described in WO 2005/001878. In this way, the advantages of, for example, the MR TOF system of Nazarenko can be achieved in a simple and low cost manner using the present invention. The present invention thereby enables a high-resolution TOF mass spectrometer, especially of multi-reflection TOF type comprising a plurality of ion mirrors, utilising collimated ion packets coming in close proximity or contact to conductive surfaces.

The ion beam is collimated in at least one direction, such as the shift direction Z mentioned above. This is sufficient since ion mirrors can focus the beam in the other two directions to prevent beam divergence in those directions. Thus, the beam is preferably collimated in at least a direction other than the directions in which the beam is focused by one or more ion mirrors as the beam travels along the ion path. Thus, herein, collimated (or parallel) in relation to the ion beam means collimated (or parallel) in at least one direction. The ion beam is substantially collimated or parallel meaning that a small divergence is permitted since perfect collimation is not possible in practice. The beam is preferably collimated downstream of the ion source, for example by transforming a diverging ion beam from the ion source into a substantially collimated, parallel ion beam. The ion beam from the ion source, once collimated, is then directed along the ion path to the ion detector. The beam collimation may be facilitated, for example, by using a collimating lens as the collimator downstream of the ion source to transform a diverging ion beam from the ion source into a substantially collimated or parallel ion beam, more preferably before the ion beam reaches any ion mirror. Other types of collimator could be used, e.g. one or collimating apertures (which could be one or more surfaces coated and/or heated to reduce the variation in their surface patch potentials). The divergence of the collimated ion beam in the at least one direction, such as the shift direction Z, is preferably 5 mrad or less, more preferably 1 mrad or less, still more preferably 0.5 mrad or less and most preferably 0.2 mrad or less.

The one or more surfaces are typically a plurality of surfaces. Due to ion deposition on them, the one or more surfaces should be electrically conductive. As the ion beam travels from the ion source to the ion detector, preferably as a substantially parallel beam, preferably small, widening wings (i.e. outer portions) of the beam are preferably clipped by the one or more surfaces, such that the one or more surfaces preferably form collimating apertures made of conductive materials. The portion of the ion beam that comes into contact with the one or more surfaces is thus an outer portion of the ion beam. Thereby the one or more surfaces are for maintaining a collimated ion beam, i.e. a beam of low divergence. The one or more surfaces are preferably located outside of the ion source. Thus, the one or more surfaces are not merely heated surfaces forming part of an ion source, such as an electron impact (EI) ion source. The one or more surfaces advantageously may be located in the example of a MR TOF spectrometer in a drift region between ion mirrors, especially a field free drift region.

There may be one or more such collimating apertures, preferably a plurality of collimating apertures. Where there are more than one such collimating apertures they are preferably periodically spaced, e.g. so that the beam is clipped by the apertures after a given number of reflections in the ion mirrors, for example after every reflection or after every two reflections. Thus, the low divergence of the beam can be maintained as the beam travels along the ion path by simple collimating apertures. Thus, causing a portion of the ion beam to come into contact or close proximity with the one or more surfaces (preferably forming collimating apertures) prior to reaching the ion detector is a means of controlling the divergence of the ion beam, for example as it undergoes multiple reflections in a MR TOF arrangement. It will be appreciated that in other types of mass spectrometer, such as magnetic sector mass spectrometers, it also may be desirable to use a low divergent (collimated) ion beam such that beam clipping with surfaces having low variation of surface patch potentials as provided by the present invention would be advantageous as well.

The invention advantageously has utility in an optical arrangement of the general type described in SU 1,725,289 of Nazarenko. In such embodiments, the invention preferably provides two opposing elongated planar ion mirrors, wherein the ion beam is repeatedly reflected between the mirrors whilst undergoing displacement in the direction of mirror elongation (the "shift direction", Z). Preferably, the mirrors are optimised to eliminate time-of-flight aberrations up to at least $1^{st}$ order (more preferably up to $3^{rd}$ order). As mentioned above, the mirror performance of the optical arrangement in SU 1,725,289 is limited due to unrestricted divergence of the ion beam along the shift direction, Z. The periodic focusing lenses employed by Verentchikov et al. in WO 2005/001878 to compensate this add considerable complexity and cost. The present invention enables such a planar mirror optical arrangement to be used without the periodic focusing lenses. The divergence of the ion beam is controlled, i.e. kept very low, in the shift direction, Z. This may be achieved by forming a collimated ion beam, e.g. using a collimating lens, or other collimating device, downstream of the ion source to transform a diverging ion beam from the ion source into a substantially parallel beam, with minimal divergence in the Z direction, preferably before the ion beam reaches the ion mirrors. The parallel ion beam is of low divergence in the Z direction of preferably 1 mrad or less, more preferably 0.5 mrad or less and most preferably 0.2 mrad or less. The low beam divergence may be maintained as the ion beam moves in the shift direction, Z, by means of one or more, preferably a plurality of, collimating apertures positioned between the mirrors, typically midway between the mirrors. The one or more collimating apertures are formed by the one or more surfaces encountered by the ion beam. In this way, the ion beam preferably passes through the collimating apertures as it is reflected from one mirror to the other.

In order to provide beam clipping by at least one collimating aperture to maintain low beam divergence, the ions come close to and/or contact conductive surfaces, i.e. the surfaces of the aperture(s). As ions come nearby to the surfaces of at least one collimating aperture, they will experience the influence of local perturbations of surface voltages, herein referred to as surface patch potentials. For metals typically used in mass spectrometry, such as stainless steel, nickel-coated aluminium, Invar etc., these variations in surface patch potentials could, in the worst cases, reach hundreds of millivolts (meV) as described in J. B. Camp, T. W. Darling, R. E. Brown. "*Macroscopic variations of surface potentials of conductors*", J. Appl. Phys., 69 (10), 1991, p. 7126-7129, which describes measurements of patch potentials of various conductive surfaces in the context of shielding of electrical background in various experiments involving very low energy charged particles. These patch potentials are rarely addressed in mass spectrometry as they are typically more than compensated by focusing lenses, for example the focusing lenses in WO 2005/001878. However, in the absence of such focusing lenses, and for low divergent ion beams with orthogonal energy spread $E_t$ of just a few millivolts (mV), these patch potentials produce significant and unpredictable perturbations of ion beams, possibly resulting in 0.1 mrad added angular spread at each pass, e.g. after each reflection. To avoid such perturbations and subsequent loss of performance in cases without such focusing lenses, the present invention minimises these surface patch potentials. This allows, for example, one or more simple collimating apertures to be used in combination with a low divergence ion beam and avoids a complex periodic lens arrangement to compensate the beam divergence.

The surface patch potentials of the one or more surfaces which are encountered by the ion beam may be reduced by any of the following preferred means. In some embodiments, a coating of a material having a lower variation in surface patch potentials than the material on which it is coated is provided. The coating is thus preferably a coating of material having a low patch potential, for example preferably of less than 1V, more preferably of less than 0.1V. Such coatings are preferably uniform coatings of material to minimise surface patch potential variation. Preferably, the coatings are smooth, more preferably with roughness value Ra<0.2 μm. The coatings are preferably free of bubbles. Uniform coatings of materials known for their low patch potential may be employed on the surfaces. Preferably, relatively un-reactive material is used for the coating. Preferably, the coatings are of one or more of the following low patch potential materials: graphite, gold, and molybdenum, especially graphite and gold. The coating materials are preferably amorphous or polycrystalline. That is, useful coating materials may be, for example, amorphous or polycrystalline coatings of the previously mentioned materials, e.g. polycrystalline gold, molybdenum and other polycrystalline materials. The coatings may be formed by any suitable method, for example, by physical vapour deposition, sputtering, or evaporation, or, less preferably, by chemical vapour deposition, or electroplating, or by other methods. Examples of low patch potential coatings thus include graphite, sputtered gold, sputtered molybdenum and other polycrystalline materials. The surface coating may be less than 1 μm thick.

In some embodiments, either in addition to the provision of the coating or as an alternative to it, the invention comprises heating the one or more surfaces to reduce the variation in their surface patch potentials, i.e. maintaining the one or more surfaces at an elevated temperature while the portion of ion beam encounters them, during analysis. For instance, a heating regime can be provided that minimises the patch potentials, e.g. by periodic or constant heating or bake-out of these surfaces, in vacuum, preferably up to a temperature of the one or more surfaces in the range of 100 to 300° C. The one or more surfaces are preferably provided in an evacuated region, e.g. as present in TOF mass spectrometers. The ion path from the pulsed ion source to the ion detector is preferably evacuated, as known in the art. Without the scope of the invention being limited by any theory, it is thought that heating can facilitate the formation of uniform surface films, e.g. as described in F. Rossi, G. I. Opat, "*Observations of the effects of adsorbates on patch potentials*", J. Phys. D: Appl. Phys. 25, 1992, 1349-1353. Heating of the one or more surfaces may be provided by a suitable means, such as resistive heating tracks for example, located in thermal contact with the surfaces, or heating means for irradiating the surfaces, such as halogen and IR lamps irradiating the surfaces. A means of local heating of the one or more surfaces is preferred, i.e. heating of the surfaces independently of other components of the spectrometer.

The present invention stands in stark contrast to the prior art TOF designs, wherein no practical provisions were discussed for minimising variations in patch potentials since it was not realised that this would be a problem. The invention is based on a realisation that the effect of reducing patch potential variations can be used to great advantage in multi-reflection TOF systems to permit use of very low divergence ion beams to achieve high resolution and sensitivity. In other words, when ion packets from a pulsed source are converted into parallel, low-divergent ion beams, for optimum performance it is extremely important to avoid any uncontrolled potentials, especially when ions fly in close proximity to conductive, especially metal, surfaces and some of the ions fall on those surfaces. This is achieved by the above mentioned special coatings on the surfaces and/or elevated temperature to provide low variation of surface potential. This is especially important in multi-reflection systems.

BRIEF DESCRIPTION OF THE FIGURES

In order to more fully understand the invention, various embodiments will now be described in more detail by way of examples with reference to the accompanying Figures in which.

DETAILED DESCRIPTION OF THE INVENTION

Figure 1:
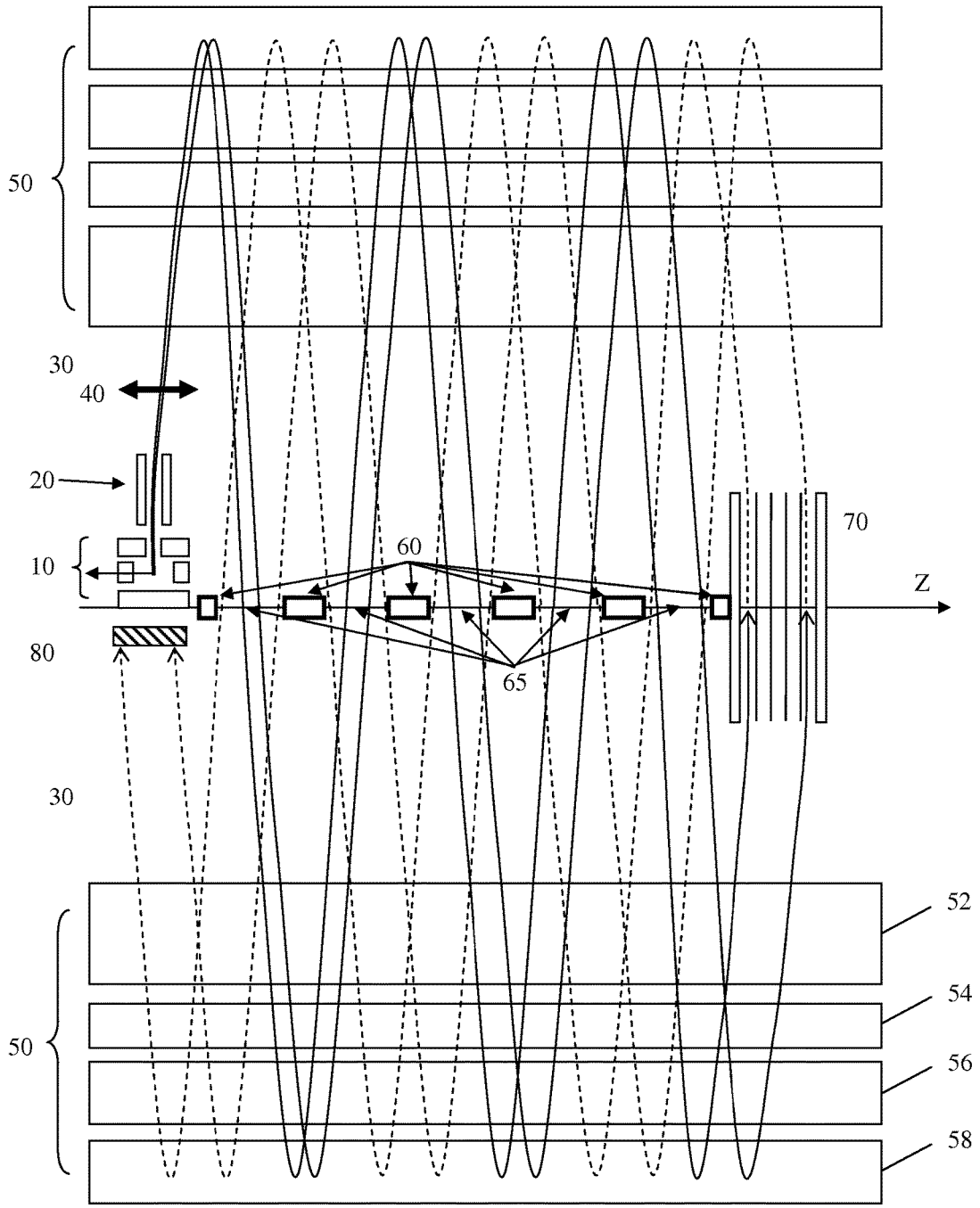
FIG. 1 shows schematically an embodiment of the present invention.

One preferred embodiment of the present invention is presented in FIG. 1. It is a multiple reflection time-of-flight mass spectrometer comprising two parallel planar mirrors 50 opposing each other as known in prior art. Improvements provided in accordance with the present invention are now described.

Ions generated (from a device not shown but which could be any conventional device such as an electrospray ionisation) enter a linear RF-only storage trap or multipole 10 of a type described in described in WO 2008/081334 perpendicularly to the plane of the drawing and are initially stored within it. Whilst stored in the multipole, the ions lose energy in collisions with a bath gas therein (preferably nitrogen). After the ions are thermalized in this way, the RF is switched off from the multipole and the ions are radially extracted from it as a pulsed beam as described in WO 2008/081334. In the case of implementation in a TOF spectrometer, it will be appreciated that the ion source will be a pulsed ion source, i.e. to produce a pulsed beam of ions comprising short ion packets. A preferred pulsed ion source comprises an ion storage device, such as an ion storage trap, providing pulsed extraction of an ion beam therefrom, an example being the multipole arrangement 10 and more specifically such as the device of WO 2008/081334. The pulsed extraction may be radial or axial pulsed extraction from the storage device, preferably radial as described, for example, in WO 2008/081334.

The pulsed beam from the storage trap 10 is extracted into a lens system 20. This lens system could include a deflector, or alternatively be tilted together with multipole 10, to define the initial angle of ion trajectory as it enters the first of the mirrors and thus its rate of drift in the shift direction Z. After that, the ion beam enters field-free region 30 and is allowed to diverge until it enters focusing lens 40 (indicated schematically by the double headed arrow). This lens 40 transforms the original beam extracted from the multipole into a parallel one with low divergence of preferably <1 mrad with corresponding increase of its width (i.e. its dimension in the direction perpendicular to Z).

Thus, a low divergence along Z direction is achieved by transforming the initially thermalized ion beam from a small-diameter thread having a thermal spread of radial velocities into a wide ribbon with an ultra-low spread of transverse velocities (i.e. in the shift direction Z). For example, the transverse velocity $v_t$ could be presented as orthogonal energy: $E_t=mv_t^2/2$. Then, if ions stored in the linear RF-only trap are radially extracted after removal of RF their initial $E_t$ can be limited, for example, by 25 to 50 meV and their initial radius by 0.1 to 0.2 mm. After acceleration by 10 kV voltage (presumed aberration-free), this corresponds to phase volume of 0.2 to 0.4 π*mm*mrad. Using a lens with a focal length of F=200 mm located at the point corresponding to effective length F from the beam starting point, such a beam could be transformed into a beam of less than 10 mm full width and angular divergence of less than 0.2 mrad in the shift direction.

After that, the collimated ion beam repeatedly reflects in ion mirrors 50 which comprise a plurality of electrode sections 52, 54, 56 and 58 to which suitable voltages are applied. It will be appreciated that four electrode sections are shown in Figure for simplicity but a greater or lesser number of electrode sections could be used as described further with reference to FIG. 2 below. As the ion beam repeatedly reflects between ion mirrors 50 it passes through the diaphragms 60 which define apertures 65 therein, i.e. collimating apertures. The diaphragms 60 are made of conductive material, typically a metal such as stainless steel, nickel coated aluminium or Invar. As the collimated ion beam continues to expand due to higher-order aberrations, its wings are increasingly clipped by diaphragms 60 and this is where surface patch potentials could be formed and could vary, thereby perturbing the beam. In accordance with the present invention, the surfaces of the diaphragms 60 forming the collimating apertures 65 are coated with material having low patch potential such as graphite or polycrystalline gold. Alternatively to such coating, or in addition, the diaphragms 60 may be heated, e.g. at a surface temperature from 100 to 300° C. to reduce the variation in surface path potentials. Thus, the collimated ion beam remains highly collimated and only its outer wings or edges become clipped.

As the beam reaches the end of mirrors 50 at the maximum extent of travel in the shift direction Z, it may be detected by a detector. Alternatively, as shown in FIG. 1, the beam is sent on a return path by a deflector 70 thereby doubling the ion flight path length and increasing the resolution of the mass spectrometric separation. The deflector 70 could also be made as a multi-deflector using double-sided printed-circuit boards (PCBs), so that chromatic aberrations are reduced. Some of the ions may also be clipped by metal surfaces of the deflector 70, which if necessary could also be coated and/or heated as described above to reduce surface patch potentials of the deflector.

After returning back on the return path along the trajectory shown by the dashed lines, the ions continue to get clipped by diaphragms 60 until they reach ion detector 80 and are detected. The detector may be any conventional type of ion detector, for example such as an electron multiplier or MCP.

Figure 2:
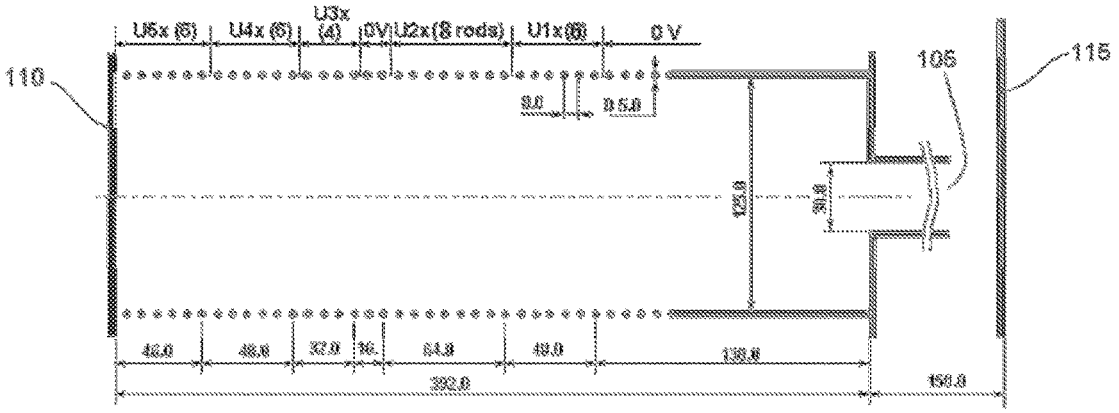
FIG. 2 shows schematically a specific example of the structure and voltages of an ion mirror for use in the embodiment of the present invention shown in FIG. 1.

In FIG. 2 there is shown a specific example of the design and voltages for the ion mirrors in the embodiment of the present invention shown in FIG. 1. One of the mirrors is shown in side cross-sectional view in the X-Y plane, i.e. orthogonal to the shift direction Z in FIG. 1. The entrance to the ion mirror is located at the right hand side of the drawing and comprises an aperture 105 of reduced diameter compared to the internal diameter of the ion mirror. The rear of the mirror, which the ions do not quite reach as they penetrate into the mirror, is located at the left hand side of the drawing and shown by the vertical line 110. The central axis (i.e. Z axis) located mid-way between the two ion mirrors 50 in FIG. 1 is shown by the vertical line 115 at the right hand side of the mirror. The dimensions shown on the mirror in the drawing are given in millimeters. Whereas the ion mirrors 50 in FIG. 1 are shown comprising four electrode sections 52, 54, 56 and 58 for simplicity, the mirror in FIG. 2 comprises more than four sections. Each section comprises one or more conductive rods shown in cross-section by the circles. The rods are preferably made from a metal such as stainless steel, Invar, molybdenum, or nickel-coated aluminium. As an alternative to rods, plates or printed circuit boards could be used to form electrodes. The rod diameter in the example is 5 mm and the rod spacing (i.e. spacing between adjacent rods) is 8 mm. The mirror comprises a first electrode section closest the mirror entrance of 4 rods wherein the rods carry a voltage of 0 V in use. The next electrode section after that consists of 6 rods and carries a voltage U1x. The next electrode section after that consists of 8 rods and carries a voltage U2x. The next electrode section after that consists of 2 rods and carries a voltage 0 V. The next electrode section after that consists of 4 rods and carries a voltage U3x, followed by another section that consists of 6 rods and carries a voltage U4x and finally a last electrode section that consists of 6 rods and carries a voltage U5x. Examples of the voltages are shown (in volts) in the Table in FIG. 2 for ions initially accelerated by 2 kV. It will be appreciated that the voltages may be applied by a suitable power supply (not shown).

Herein, the term mass-to-charge ratio (m/z) also includes parameters which can be converted into m/z, for example time-of-flight.

Herein, unless the context indicates otherwise, singular forms of the terms herein are to be construed as including the plural form and vice versa. For instance, unless the context indicates otherwise, a singular reference herein including in the claims, such as "a" or "an" means "one or more".

Herein, the words "comprise", "including", "having" and "contain" and variations of the words, for example "comprising" and "comprises" etc., mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described herein may be performed in any order or simultaneously unless stated or the context requires otherwise.

All of the features disclosed herein may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of analyzing ions according to their mass-to-charge ratio comprising directing a collimated ion beam along an ion path from an ion source to an ion detector, causing a portion of the ion beam to pass one or more electrically conductive surfaces prior to reaching the ion detector, wherein the one or more surfaces form collimating apertures to maintain the collimated ion beam, wherein the method further comprises reducing variation in surface patch potentials of the one or more surfaces by performing at least one of: (i) providing a coating on the one or more surfaces, wherein the coatings have a lower variation in surface patch potentials than a surface material on which it is coated, and (ii) heating the one or more surfaces.

2. A method as claimed in claim 1, wherein the ion beam is generated as a pulsed ion beam from a pulsed ion source.

3. A method as claimed in claim 1, wherein the method further comprises separating the ions according to their time of flight along the ion path.

4. A method as claimed in claim 1, wherein the ion beam undergoes multiple changes of direction between the ion source and the detector.

5. A method as claimed in claim 4, wherein the ion beam undergoes multiple reflections in ion mirrors.

6. A method as claimed in claim 5, further comprising providing two opposing elongated planar ion mirrors, wherein the collimated ion beam is repeatedly reflected between the mirrors whilst undergoing displacement in the direction of mirror elongation, the shift direction Z.

7. A method as claimed in claim 6, wherein the ion beam is collimated in the Z direction.

8. A method as claimed in claim 1, further comprising collimating the ion beam downstream of the ion source.

9. A method as claimed in claim 1, wherein the collimating apertures are periodically spaced apart.

10. A method as claimed in claim 1, wherein the divergence of the collimated beam is 1 mrad or less.

11. A method as claimed in claim 1, wherein the coating comprises a coating of an amorphous or polycrystalline material.

12. A method as claimed in claim 1, wherein the coating comprises a coating of graphite, gold, or molybdenum.

13. A method as claimed in claim 1, wherein the heating of the one or more surfaces comprises heating the one or more surfaces at a temperature in the range of 100 to 300° C.

* * * * *